United States Patent [19]

Freeman

[11] 4,018,153

[45] Apr. 19, 1977

[54] TAPE HANDLING APPARATUS UTILIZING TANGENTIAL WEB CONTACT FOR POSTAGE METER

[75] Inventor: Gerald C. Freeman, Darien, Conn.

[73] Assignee: Pitney-Bowes, Inc., Stamford, Conn.

[22] Filed: May 16, 1975

[21] Appl. No.: 578,121

[52] U.S. Cl. ..... 101/93; 101/225; 101/288; 226/80; 226/86

[51] Int. Cl.[2] ..... B41F 1/08

[58] Field of Search ..... 101/225, 227, 228, 232, 101/234, 92, 93, 292; 226/80, 86

[56] References Cited

UNITED STATES PATENTS 3,791,293 2/1974 Rastorguyeff ..... 101/234

*Primary Examiner*—Edgar S. Burr
*Assistant Examiner*—R. E. Suter
*Attorney, Agent, or Firm*—Robert E. Meyer; William D. Soltow, Jr.; Albert W. Scribner

[57] ABSTRACT

Apparatus for handling a multi-layer tape in a postage meter printing machine wherein a portion of the tape is printed with indicia and advanced to the operator and a protective backing portion is wound up on a motor-driven reel after being separated from the printed portion. Advancement of the backing portion of the tape by the reel advances the separated printed portion to the operator. Prior to being wound on the reel, the backing portion of the tape is guided around two sets of rollers defining three points of tangency with a star wheel having radial projections in registration with slots formed in the edge of the backing portion of the tape. Advancement of the backing portion of the tape rotates the star wheel, which includes a plurality of pins which cooperate with a switch to deactuate the motor of the wind-up reel after the star wheel has rotated through a predetermined arc. Deactuation of the means for advancing the tape after the star wheel has rotated through a predetermined arc assures that a precise unit of the printed portion of the tape is presented to the operator.

3 Claims, 6 Drawing Figures t-1
t-2
t
40
24
12
20
30
T
16
22
14
18
10
28
26
68
72
52
54
56
58
64
50
g
H
R
h
C
S

TAPE HANDLING APPARATUS UTILIZING TANGENTIAL WEB CONTACT FOR POSTAGE METER

BACKGROUND OF THE INVENTION

1. Field of the Invention

This invention relates to an apparatus for handling tape, and more particularly, to an apparatus for handling tape in a postage meter type printing machine.

2. Description of Prior Art

This invention is an improvement to U.S. Pat. No. 3,791,293 assigned to the assignee of the instant invention and said patent is incorporated by reference into this specification. U.S. Pat. No. 3,791,293 discloses a flatbed printing machine of the postage meter type which can print selectively on letters or on a tape, which in the case of the latter, can be adhered either to an envelope or a parcel. A composite tape is used when the machine is in its tape mode.

The composite tape comprises a print receiving first strip which has a backing of pressure sensitive adhesive. This strip is divided into units of equal length by perforations defining lines of tear across the tape. A protective second strip is adapted to overlie the adhesive backing of the first strip. The protective second strip extends laterally beyond the first strip along one edge. The extended edge portion of the second strip is slotted with slots, or perforations, the midpoints of which, are spaced apart the same distance as the lines of tear in the first strip and are aligned with the lines of tear in the first strip.

The composite tape is threaded through the postage meter printing machine so that an impression can be formed during each print operation on either one or two units of equal length of the first strip of the tape, each unit being defined by the lines of tear across the tape. As the tape is threaded through the postage meter type printing apparatus the tape is advanced from a source of supply such as a tape roll mounted on a first reel, over guide means, and a vertically reciprocable track, and at the outer end of the track the protective second strip is separated from the first strip and is led back and its free end is engaged with a second reel which is power-driven to wind up the second strip and thereby advance both strips. The free end of the print-receiving strip, which has been projected from one end of the machine, is torn off at a line of tear which disposed adjacent to point of separation between the two tape strips and also adjacent to the end of the machine, after each print operation.

With the tape threaded through the tape handling apparatus as described above and a postage meter properly assembled with it, a label printing and advancing operation is initiated by the operator depressing a key of the postage meter thus actuating its platen and elevating the tape track bringing the tape which is on the track into contact with the printing head which is within the postage meter.

In falling back to its lower position, the tape supporting track causes actuation of a switch which turns on a motor. The rotation of the motor shaft turns the reel on which the protective second strip is wound up, also unwinding the composite tape from a tape supply reel and advancing it a predetermined distance through the guide means and over the track.

Adjacent the take-up reel, a star wheel is rotated by the advancing protective second tape strip which initially is the underply of the aforementioned two-ply tape strip. The star wheel is described in detail in U.S. Pat. No. 3,712,527, assigned to the same assignee as the present invention, and said patent is incorporated be reference into this specification.

The star wheel has peripheral radial projections that are engaged in the slots or perforations along the extended edge portion of the second strip or the underply protective backing of the two-ply strip, and a predetermined number of circularly disposed contact pins projecting from its rear surface, the spacing between the pins being determinative of the length of the tape advance. The star wheel is rotated through meshing engagement of the slots in the advancing tape with the peripheral radial projections on the star wheel, as the tape is advanced. The contact pins projecting from the star wheel are used either through an intermediate member or directly to strike and raise the switch arm of the switch controlling the motor advancing the tape take-up reel, thus deactuating the motor and stopping the travel of the tape after each advance of a distance equal to the length of either one or two predetermined units of the tape strip. As shown in U.S. Pat. No. 3,712,527, the contact pins can directly strike the switch arm, or as in U.S. Pat. No. 3,791,293, the pins can be used to activate a segmental cam through a linkage of a series of interacting members to strike the switch arm. Depending upon the number of pins which are manually projected from the rear surface of the star wheel, as shown in said U.S. Pat. No. 3,712,527, the motor on the take-up reel is deactuated after an advance of the tape a distance equal to the length of one or two units, as desired, after each print operation.

In the printing device illustrated in U.S. Pat. No. 3,791,293, the tape which advances the star wheel is wrapped around the star wheel circumference for an appreciable length so that the tape not only drives the star wheel through the meshing engagement of its radial projections and the slots in the tape, but by the frictional engagement of the surface of the tape itself with the cylindrical surface of the star wheel. If for some reason, the slots in the edge of the tape become mis-aligned (out of time) with a radial projection on the star wheel, the star wheel projection could puncture the tape creating its own slot which in turn will cause rotation of the wheel and its pin contacts during successive print operations to prematurely deactuate the tape drive or slippage may occur between the frictional engagement of the wheel and tape without the projections on the wheel being aligned with the slots in the tape, which will result in too little or too much tape being presented to the operator in advance or in arrears of the tear line. Furthermore, if a radial projection on the star wheel makes contact with the tape as it is advanced before entering a slot in the tape edge, the tape can break, necessitating rethreading of the tape in the machine.

SUMMARY OF THE INVENTION

The present invention relates to apparatus for correcting the possible misalignment of the tape and star wheel in a printing machine of the postage meter type such as shown in U.S. Pat. No. 3,791,293. The apparatus of the present invention proposes means for maintaining the tape in a series of substantially tangential relationships to the circumference of the star wheel in the path of rotation of the radial projections as the tape is advanced so that the radial projections will enter the slots in the tape at the point of tangency of the tape to the star wheel precluding premature contact of the projections with the tape and binding and breaking of the tape.

This is accomplished by providing two series of rollers spaced from and in juxtaposition to the star wheel for guiding the tape as it is advanced. The tape is threaded about these rollers so as to maintain the tape in tangential relation to the circumference of the wheel. Three points of tangency are established, each spaced approximately 45° about the circumference of the star wheel.

Since the tape is maintained in substantially linear relation with respect to the circumference of the star wheel, the distance between the radial projections around the circumference of the star wheel is easily translated into a linear relationship corresponding to distance between the midpoints of the slots in the tape so as to effect continuous contact of the radial projections on the star wheel with each slot in the tape.

Further objects and advantages of the present invention will become more apparent from the following specification and claims and from the accompanying drawings, wherein:

DETAILED DESCRIPTION OF THE PREFERRED EMBODIMENT

Figures 1, 2, 3:
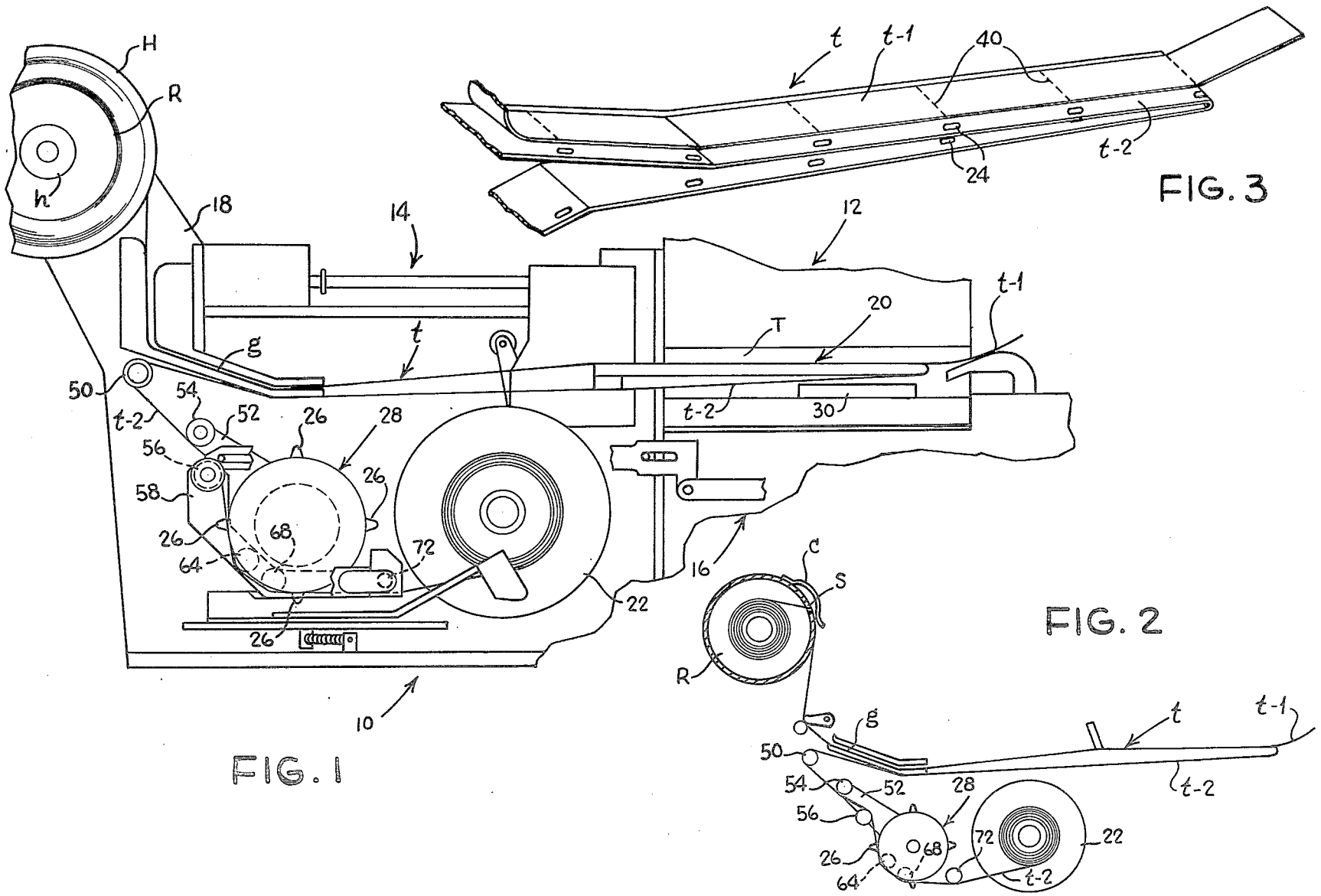
FIG. 1 is the front view in elevation of a flatbed printing machine of the postage meter type, with the front cover of the machine removed and with parts omitted, partly cut away, and with others in cross-section, for purposes of clarity in illustrating the present invention.
FIG. 2 is a diagrammatic illustration showing the position of the tape when threaded through the machine.
FIG. 3 is a perspective view showing a length of the composite tape disposed as it is on the tape track of the machine.
Figure 5:
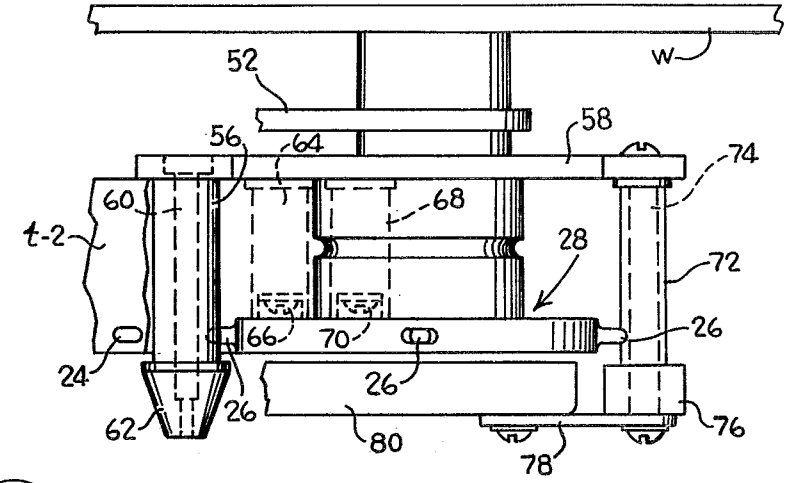
FIG. 5 is a top view in elevation of the tape handling apparatus illustrated in FIG. 4.
Figure 4:
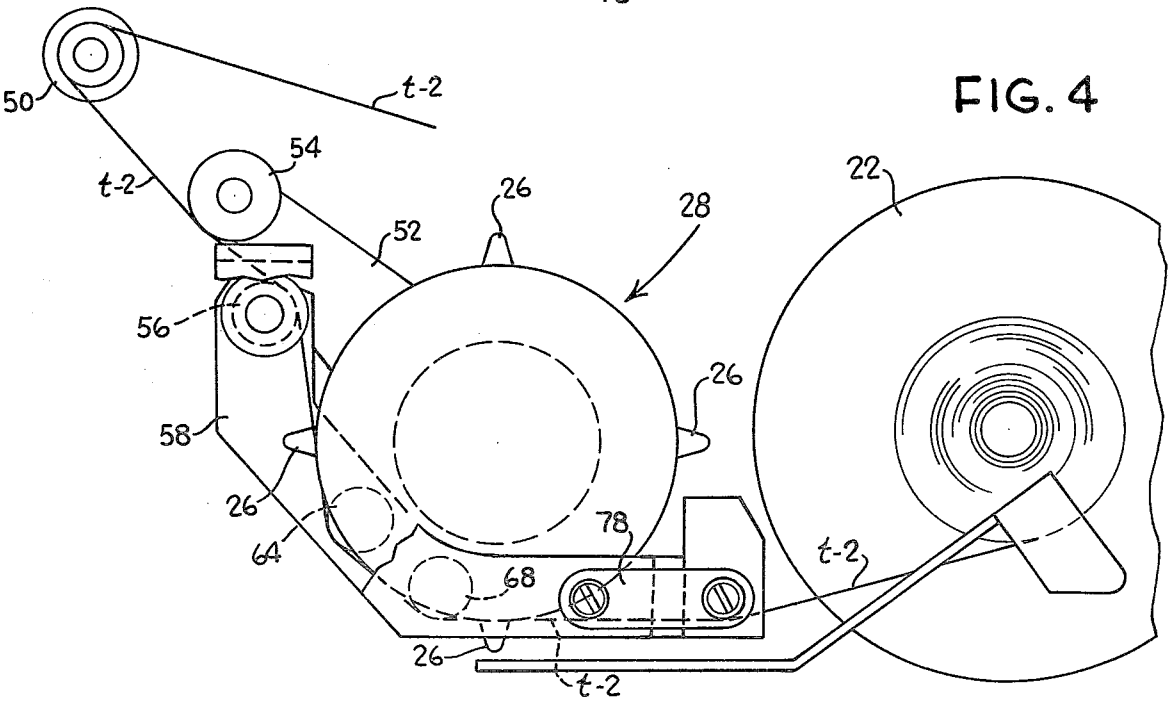
FIG. 4 is a front view in elevation of an enlarged detail of the machine illustrated in FIG. 1 showing the relationship of the star wheel and the tape as it is advanced through the machine.
Figure 6:
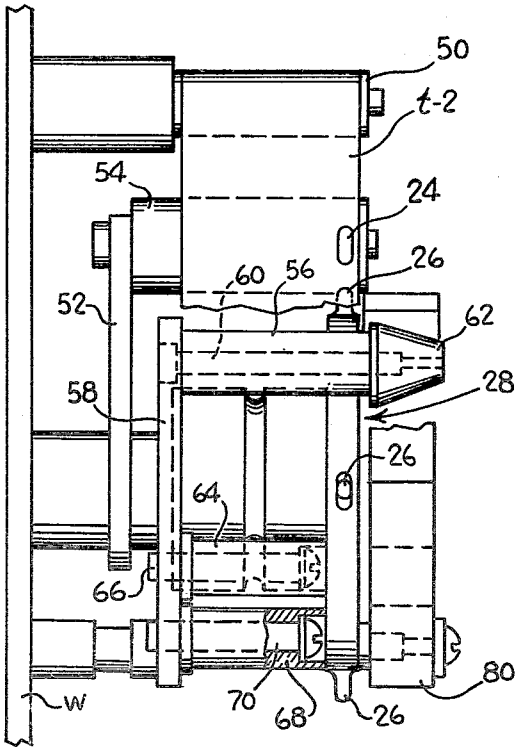
FIG. 6 is a side view in elevation of the tape handling apparatus illustrated in FIG. 4 as seen from the left hand side of FIG. 4.

Referring now to the drawings in detail, wherein like numerals indicate like elements throughout the several views, a machine generally indicated by the numeral 10 is illustrated in FIG. 1, which is a flat-bed printing machine of the postage meter type which can print indica selectively on letters or on a tape. The operation and details of construction of this machine are described and illustrated in U.S. Pat. No. 3,791,293, assigned to the same assignee of the instant invention. Further reference to details of this machine will only be made to that portion constituting the improvement in the machine which is the subject matter of this invention, except for purposes of background information.

The machine 10 generally comprises 3 sections, indicated by the numerals 12, 14 and 16, respectively. Section 12 is a postage meter of known kind for printing a postage stamp impression with or without other indicia in the upper right hand corner of letters or on a tape which can be adhesively secured to a letter or parcel.

Section 14 contains a tape handling means including a tape carrier projectible into the throat T of the postage meter comprising Section 12. Section 16 laterally adjoins Section 14 and provides a base on which Section 12 is placed. It contains a drive means for actuating a letter eject mechanism when the machine is in letter operating mode, and for driving a tape strip pick-up roll when the machine is in tape operating mode. It also contains means connected with means in Section 14 and responsive to the position of the tape carrier for shifting the drive means between letter and tape operating modes.

Tape *t* from a supply roll R mounted on the hub *h* of the tape supply roll holder H rotatively mounted on an arm 18 extending up from the left hand end of Section 14 is fed through a slot *s* in the holder H and under the tensioning end of a spring clamp C as illustrated in FIG. 2, which extends over the slot *s*. The tape *t* is then fed through a guideway *g* to a tape carrier 20 which is spaced from the forward end of the guideway *g*.

The tape *t* is used in the machine is a composite tape of the kind described in detail in both U.S. Pat. Nos. 3,791,293 and 3,712,527. The tape *t* is illustrated in FIG. 3 and is provided with a print-receiving top ply tape strip *t*-1, which is separated from an under ply protective strip *t*-2 adjacent the forward end of tape carrier 20. The protective strip *t*-2 extends all the way from the tape supply roll R to take-up reel 22 and not only carries strip *t*-1 with it to the point of separation but also has slots 24 in its margin which engage peripheral radial projections 26 on a star wheel generally indicated by numeral 28. Tape strip *t*-2 causes the star wheel 28 to rotate through meshing engagement of slot 24 with peripheral radial projections 26 as the tape strip *t*-2 is advanced and wound up on the pick-up reel 22.

As described in U.S. Pat. No. 3,791,293, a platen 30 is raised each time a starting switch control button is depressed and lifts any workpiece positioned within the throat T into contact with a flat-bed printing means (not shown) disposed above the throat T. In this manner indicia can be printed upon tape ply *t*-1. The manner of lifting tape guide 20 by the platen 30 during the printing operation is set forth in said U.S. Pat. No. 3,791,293, and does not comprise any portion of the present invention.

The star wheel 28 has about its periphery radial projections 26 adapted to engage slots 24 provided along one margin of the tape strip *t*-2 and has projecting from its rear face a preselected number of pins (not shown), the spacing between said pins determining the extent of each tape advance subsequent to the printing operation. Star wheel 28 and its manually positional pins are described in great detail in U.S. Pat. No. 3,712,527, and are shown in U.S. Pat. No. 3,791,293, and since per se they do not constitute a part of the instant invention they are not described herein except to point out that when the tape strip *t*-2 is advanced star wheel 28 is rotated due to the engagement of the projections 26 in tape holes 24; and the number of pins projecting from the rear face of the star wheel may be controlled, as shown in said U.S. Pat. No. 3,712,527. When four pins are projected the distance between successive projected pins corresponds with a unit length of the tape strip *t*-1, which desirably is the distance between transverse perforations 40 in the tape strip *t*-1. When only two pins are projected, the distance between them corresponds with the length of two tape units. Therefore only two diametrically opposed pins are employed when it is desired to print a label equal in length to two units of the tape strip *t*-1, and four pins are used when it is desired to print only one unit length of the tape.

As shown in U.S. Pat. No. 3,791,293, as star wheel 28 is rotated after each printing operating wherein the tape *t* is advanced, the projecting pins on the rear face of the star wheel 28 are adapted to strike a segmental cam which deactuates a switch controlling the driving of take-up reel 22. When the switch is deactuated, tape *t*-1 should have been advanced after the printing operation a sufficient distance so as to present either one or two unit lengths of the tape *t*-1 to the operator for tearing at a perforation 40.

As shown in U.S. Pat. No. 3,791,293, the tape strip *t*-2 was heretofore wrapped for an appreciable length about the circumference of the periphery of star wheel 28. By virtue of this arrangement, it was found that the radial projections 26 often became misaligned with the slots 24 in tape strip *t*-2 since the projections were engaged with the margin of tape ply *t*-2 prior to or subsequent to alignment of a slot 24 with the projection. This would either cause the tape to break rendering subsequent printing operation impossible until the tape was rethreaded through the machine, or among other things, the projections would pierce the marginal portion of tape ply *t*-2 and the tape would advance rotation of the contact pins on back of the star wheel to prematurely deactuate the reel take-up motor.

In order to correct the possibility of misalignment, tape ply *t*-2 is presented to star wheel 28 in substantially tangential relation to the circumference of the star wheel at a number of points on the circumference in the path of rotation of the radial projections 26.

This is accomplished by projecting the print receiving tape ply *t*-1 beyond the right hand end of the postage meter and the lower ply tape strip *t*-2 is then led back under the tape carrier 20 and around a guide roller 50 which is positioned adjacent to the left hand end of the machine. Mounted for rotation on the shaft of the star wheel is a tape slack control arm 52, which at its outer end carries a roller 54 which rests on the tape strip *t*-2. Tape strip *t*-2 is then threaded over a roller 56 mounted for rotation on a bracket 58 connected by any suitable means to a wall W in the machine. Roller 56 is rotatable about the shank 60 of a counter-sunk bolt carried by bracket 58 and held on the shank 60 by means of a nut 62. Tape strip *t*-2 is then brought into tangential relation with the circumference of star wheel 28 and wrapped around a second roller 64 rotatively mounted about the shank of a bolt 66 secured to bracket 58. From roller 64, tape ply *t*-2 is again brought into tangential relation with the circumference of star wheel 28 and then passes around a third roller 68 rotatively mounted about the shank of a bolt 70 similarly secured to bracket 58, and passed along a third time into tangential relation with the circumference of star wheel 28 at a point approximately 90° downstream about the circumference of star wheel 28 from the first point of tangency. A fourth roller 72 is provided to maintain the tangential relation of tape ply *t*-2 with the circumference of star wheel 28 and roller 72 guides tape ply *t*-2 to the take-up roll 22 to which it is connected in any suitable manner. Roller 72 is also mounted for rotation about the shank of a bolt 74 secured to bracket 58. At its opposite end, roller 72 is rotatively connected to a bearing 76 which through link 78 mounts a shroud or cover element 80.

In operation, the first set of rollers 56, 64 maintain the tape ply *t*-2 tangent to the circumference of star wheel 28, rollers 64 and 68 establish a second point of tangency while the rollers 68, 72 maintain the ply *t*-2 in a third tangential relation with the circumference of star wheel 28 each at positions spaced approximately 45° about the circumference of the star wheel. Therefor, the tape does not continuously contact the star wheel 28 about its circumference. After a printing operation is initiated, the take-up reel 22 is rotated to pull the tape past the circumference of star wheel 28. Radial projections 26 disposed at spaced intervals around the circumference of star wheel 28 will enter slots or perforations 24 in the margin of tape ply *t*-2 as the tape is advanced whereby as the tape is advanced the star wheel will be rotated driven only by the projections 26 that have aligned themselves in the slots 24 in the tape. Contact pins carried by the rear of the star wheel will rotate with the star wheel and after a predetermined rotation the contact pins will deactivate the drive motor for reel 22 as described more fully in U.S. Pat No. 3,791,293.

The sets of guide rollers 56, 64, 68 and 72 prevent misalignment of holes 24 and projections 26. This alignment relationship is established by translating the arcuate length between the midpoints of projections 26 into a linear length and spacing the midpoint of adjacent slots 24 in the margin of tape ply *t*-2 at that length and then retaining that linear relationship by advancing the tape ply *t*-2 past the circumference of the star wheel in substantially tangential relationship thereto at a number of points. Since more than projection is in engagement on an average, the force required to rotate the wheel is shared by the holes 24 engaged by the projections resulting in much less tendency for the hole in the tape to be damaged by excessive force being transmitted through it.

What is claimed is:

1. In an apparatus for advancing a multi-layered tape having a plurality of spaced perforations along an edge thereof through a predetermined distance said apparatus being of the type wherein said tape is advanced along a support means by a drive means, and a control means initiates the operation of said drive means to advance said tape and deactivates the operation of said drive means after said tape has advanced through a predetermined distance, and wherein said control means includes a rotatable wheel having radial projections disposed at spaced intervals around its circumference to engage the spaced perforations along the edge of the tape as the tape is advanced, wherein the improvement comprises guide means adjacent to the circumference of said wheel for maintaining said tape in a finite series of at least two substantially tangential relationships to the circumference of said wheel in the path of rotation of said radial projections, each of said tangential relationships in said series being separated from any other by a portion of said tape strip not in tangential relationship with said wheel, whereby as said tape is advanced said wheel is rotated by the perforations in said tape engaging said projections on said wheel.

2. The improved apparatus of claim 1 wherein said guide means comprises a plurality of rollers.

3. In an apparatus for advancing a multi-layered tape having a plurality of spaced perforations along an edge thereof through a predetermined distance said apparatus being of the type wherein said tape is advanced along a support means by a drive means, and a control means initiates the operation of said drive means to advance said tape and deactivates the operation of said drive means after said tape has advanced through a predetermined distance, and wherein said control means includes a rotatable wheel having radial projections disposed at spaced intervals around its circumference to engage the spaced perforations along the edge of the tape as the tape is advanced, wherein the improvement comprises guide means adjacent to the circumference of said wheel for maintaining said tape in a series of substantially tangential relationships to the circumference of said wheel in the path of rotation of said radial projections, said guide means comprising four rollers which maintain said tape in tangential relation to the circumference of said wheel at three points of tangency spaced approximately 45° about the circumference of said wheel, whereby as said tape is advanced said wheel is rotated by the perforations in said tape engaging said projections on said wheel.

* * * * *